US006500215B1

(12) United States Patent
Login et al.

(10) Patent No.: US 6,500,215 B1
(45) Date of Patent: Dec. 31, 2002

(54) UTILITY OF SELECTED AMINE OXIDES IN TEXTILE TECHNOLOGY

(75) Inventors: Robert B. Login, Simpsonville, SC (US); Otto Bella, Tryon, NC (US); Calvin McIntosh Wicker, Jr., Spartanburg, SC (US); Lynn Hosie, Charlotte, NC (US)

(73) Assignee: Sybron Chemicals, Inc., Birmingham, NJ (US)

( * ) Notice: Subject to any disclaimer, the term of this patent is extended or adjusted under 35 U.S.C. 154(b) by 182 days.

(21) Appl. No.: 09/613,372

(22) Filed: Jul. 11, 2000

(51) Int. Cl.[7] ..... D06P 1/66; D06P 1/645

(52) U.S. Cl. ..... 8/481; 8/478; 8/597; 8/598; 8/599; 8/602; 8/604; 8/196; 8/115.66

(58) Field of Search ..... 8/478, 481, 597, 8/598, 599, 602, 604, 196, 115.66

(56) References Cited

U.S. PATENT DOCUMENTS

| | | | | |
|---|---|---|---|---|
| 1,943,176 | A | | 1/1934 | Graenacher |
| 2,060,568 | A | | 11/1936 | Graenacher et al. |
| 2,179,181 | A | | 11/1939 | Graenacher et al. |
| 2,744,292 | A | | 5/1956 | Schlosser et al. |
| 2,757,148 | A | | 7/1956 | Heritage |
| 3,185,657 | A | | 5/1965 | Balitrand et al. |
| 3,236,669 | A | | 2/1966 | Williams |
| 3,239,535 | A | | 3/1966 | Searles, Jr. et al. |
| 3,253,058 | A | | 5/1966 | Isley et al. |
| 3,447,939 | A | | 6/1969 | Johnson |
| 3,447,956 | A | | 6/1969 | Johnson |
| 3,503,700 | A | | 3/1970 | Griggs |
| 3,508,941 | A | | 4/1970 | Johnson |
| 3,524,205 | A | | 8/1970 | Langmann et al. |
| 3,628,905 | A | | 12/1971 | Kirschnek et al. |
| 3,758,457 | A | | 9/1973 | Broeck, Jr. et al. |
| 4,145,532 | A | | 3/1979 | Franks et al. |
| 4,246,221 | A | | 1/1981 | McCorsley, III |
| 4,247,431 | A | | 1/1981 | Franks et al. |
| 4,247,688 | A | | 1/1981 | Franks et al. |
| 4,255,300 | A | | 3/1981 | Franks et al. |
| 4,256,613 | A | | 3/1981 | Franks et al. |
| 4,268,666 | A | | 5/1981 | Baldini et al. |
| 4,290,815 | A | | 9/1981 | Henry |
| 4,324,593 | A | | 4/1982 | Varga |
| 4,416,698 | A | | 11/1983 | McCorsley, III |
| 4,418,026 | A | | 11/1983 | Blackie et al. |
| 4,426,258 | A | | 1/1984 | Browning |
| 4,426,288 | A | | 1/1984 | Münte |
| 4,455,147 | A | * | 6/1984 | Lewis et al. |
| 4,787,912 | A | | 11/1988 | Abel et al. |
| 4,851,522 | A | | 7/1989 | Chanzy et al. |
| 5,094,690 | A | | 3/1992 | Zikeli et al. |
| 5,277,857 | A | | 1/1994 | Nicholson et al. |
| 5,330,567 | A | | 7/1994 | Zikeli et al. |
| 5,354,371 | A | | 10/1994 | Wykes et al. |
| 5,401,304 | A | | 3/1995 | Wykes et al. |
| 5,403,358 | A | | 4/1995 | Aston et al. |
| 5,409,532 | A | | 4/1995 | Astegger et al. |
| 5,441,689 | A | | 8/1995 | Laity |
| 5,451,364 | A | | 9/1995 | Ducharme, Jr. et al. |
| 5,458,835 | A | | 10/1995 | Wilkes et al. |
| 5,484,508 | A | | 1/1996 | Urwin et al. |
| 5,512,061 | A | * | 4/1996 | von der Eltz et al. |
| H1592 | H | | 9/1996 | Nicholson |
| 5,562,739 | A | | 10/1996 | Urben |
| 5,580,354 | A | | 12/1996 | Taylor |
| 5,582,786 | A | | 12/1996 | Brunskill et al. |
| 5,582,843 | A | | 12/1996 | Sellars et al. |
| 5,591,388 | A | | 1/1997 | Sellars et al. |
| 5,597,587 | A | | 1/1997 | Nicholson et al. |
| 5,601,765 | A | | 2/1997 | Sellars et al. |
| 5,603,884 | A | | 2/1997 | DuCharme, Jr. et al. |
| 5,607,550 | A | | 3/1997 | Akers |
| 5,609,957 | A | | 3/1997 | Page et al. |
| 5,634,914 | A | | 6/1997 | Wilkes et al. |
| 5,639,484 | A | | 6/1997 | White, et al. |
| 5,651,794 | A | | 7/1997 | Taylor |
| 5,662,858 | A | | 9/1997 | Firgo et al. |
| 5,671,757 | A | | 9/1997 | Woodings |
| 5,690,874 | A | | 11/1997 | Bell et al. |
| 5,709,716 | A | | 1/1998 | Taylor |
| 5,725,821 | A | | 3/1998 | Gannon et al. |
| 5,731,083 | A | | 3/1998 | Bahia et al. |
| 5,738,119 | A | | 4/1998 | Edwards, III et al. |
| 5,779,737 | A | | 7/1998 | Potter et al. |
| 5,891,375 | A | | 4/1999 | Stall et al. |
| 5,914,445 | A | | 6/1999 | Binz et al. |
| 6,099,594 | A | | 8/2000 | Kummeler et al. |
| 6,139,590 | A | | 10/2000 | Moore et al. |

FOREIGN PATENT DOCUMENTS

| | | |
|---|---|---|
| GB | 1406814 | 9/1975 |
| GB | 1441674 | 7/1976 |
| JP | 7189125 | 7/1995 |
| JP | 8209535 | 8/1996 |

OTHER PUBLICATIONS

PCT International Search Report of PCT/US01/22435—International Filing Date: Jul. 11, 2001.

Article by J.R. Aspland, School of Textiles, Clemson University, Clemson, SC entitled A Series on Dyeing (pp. 21–24; 27–31) Mar. 1998.

Japanese Publication appearing in *Journal of the Korean Fiber Society*, vol. 33, NO. 6, 1996 entitled Solvent Bonding of Cotton Fiber Assembly with N–Methylmorpholin N–Oxide with translation (19 pages) Feb. 1996.

* cited by examiner

*Primary Examiner*—Margaret Einsmann
(74) *Attorney, Agent, or Firm*—Dority & Manning

(57) ABSTRACT

A process is disclosed for treating textile materials with selected amine oxides in order to change the aesthetics and/or make the materials more receptive to dyes. In particular, the treatment causes cellulosic materials to become more cationic and thus more receptive to anionic dyes with or without stiffening. In a preferred embodiment, the process of the present invention is directed to treating fabrics containing cotton fibers but will work to a useful extent on wool, nylon and polyester. The process is carried out by contacting said fibers or fabric with selected amine oxide compositions. The amine oxide compositions can be padded onto the fabric or printed onto the fabric. If printed onto the fabric according to a particular design, the design then becomes visible on the fabric once dyed.

32 Claims, No Drawings

UTILITY OF SELECTED AMINE OXIDES IN TEXTILE TECHNOLOGY

FIELD OF THE INVENTION

In general, the present invention is directed to a process for dyeing textile fibers, yarns and fabrics, especially cotton, cellulosic, wool, nylon and polyester products. More particularly, the present invention is directed to a process for increasing the absorptivity of textile materials in order to increase their receptiveness to dyes.

BACKGROUND OF THE INVENTION

In the past, various and sundry methods and processes have been developed in order to improve the dyeability of cotton and other fibers. Further, many attempts have also been made to develop a process for dyeing fibers where the amount of dye used in the process is minimized. Decreasing the amount of dye used to dye fibers can lead to significant cost savings especially in view of the ever increasing prices of dyes and the problem of handling and disposing of spent dyebaths.

For instance, many attempts in the past to reduce the amount of dye used in a dying process for cotton fabrics or otherwise to improve the process have involved placing various chemical agents into the dye bath. Such chemical agents have included wetting agents and salts that primarily assist or facilitate exhaustion of the dyes to the fabrics. These agents also assist in leveling or uniformly applying the dye to the fabric.

Another problem that those skilled in the art have attempted to solve is the ability to dye "dead cotton". Dead cotton refers to immature cotton fibers contained within cotton fabrics. Dead cotton does not readily accept dyes. Consequently, cotton containing dead cotton has sold for substantial discounts over higher quality cotton and can not be employed to manufacture fine garments.

In view of the above, various needs currently exist for methods that will improve cotton, cellulosics, wool, nylon and polyester dyeing processes. In particular, a need exists for a process for dyeing fabrics in which less amounts of dye are used during the process or deeper shades are required that are achieved by increasing dye absorption above the normal level. A need also exists for a process for dyeing cotton fabrics that contain dead cotton so that the dead cotton becomes dyed to the same extent as the other cotton fibers.

SUMMARY OF THE INVENTION

The present invention recognizes and addresses the foregoing disadvantages, and drawbacks of prior art constructions.

Accordingly, it is an object of the present invention to provide an improved process for dyeing cellulosic materials, such as cotton, wool, nylon and polyester fibers.

Another object of the present invention is to provide a process for treating materials so that they will have a greater affinity for dyes.

Still another object of the present invention is to provide a process for chemically treating cotton fibers to make the cotton fibers appear more cationic so that the fibers will be more receptive to anionic dyes.

These and other objects of the present invention are achieved by providing a process for making textile fibers more receptive to dyes. The process includes the steps of contacting the fibers with selected amine oxides. It is believed that the amine oxide reacts with cellulosic fibers, making the fibers appear as if they are more cationic. Once contacted with an amine oxide, the cellulosic fibers are heated to a specific temperature for optimum yield and at least partially dried. The said fibers are then dyed with an anionic dye. It has been discovered that by treating the said fibers with an amine oxide makes the fiber absorb anionic dyes quicker, and dye to a deeper shade versus the untreated fiber.

Materials that can be treated in accordance with the present invention include cotton, and other cellulosic materials. Wool, nylon and polyester also respond positively albeit by what we think is an alternative mechanism such as the amine oxide functions like a carrier plasticising and swelling the fibers. The materials treated can be fibers, yarns, or fabrics. The amine oxides used in the process of the present invention can vary. For most applications, the amine oxides can be represented by the following formula:

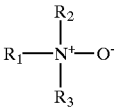

wherein $R_1$, $R_2$ and $R_3$ are $C_1$ to $C_8$ linear or branched alkane radicals or hydroxyalkyl groups.

$R_1$ and $R_2$ can be linked to form five and six membered heterocyclic rings.

$R_1$, $R_2$ and $R_3$ can be the same or different.

Examples of amine oxides includes: N-methylmorpholine oxide, N-(2-hydroxyethyl)morpholine oxide, N,N-dimethylethanolamine oxide, N-ethylmorpholine oxide, N,N-dimethyloctylamine oxide, and mixtures thereof. In one embodiment of the present invention, the amine oxide can be a trialkylamine oxide, such as trimethylamine oxide. Most amine oxides besides making cellulosic fibers more cationic have a tendency to dissolve the fibers causing the fibers to bond together, creating a stiffer product. It has been discovered, however, that trimethylamine oxide does not cause the cellulosic fibers to dissolve resulting in an even softer hand than the untreated fiber.

In order to apply the amine oxide to the textile material, the material can be dipped into an aqueous solution or dispersion containing the amine oxide. For instance, the aqueous solution can contain an amine oxide in an amount from about 20% to about 50% by weight. The aqueous mixture can be applied to the textile material so that the add on causes the weight of the material to increase up to 120%, and particularly from about 50% to about 120%.

In an alternative embodiment of the present invention, an amine oxide composition can also be printed onto the textile material. For instance, the amine oxide can be combined with a thickener for forming a printing paste. The printing paste is applied to a fabric containing textile fibers according to a particular design. Once the fabric is dyed, the design will then appear on the fabric as a more deeply dyed area.

Once the amine oxide is applied to the textile material, the textile material is then heated, such as to a temperature of from about 140° F. to about 300° F., and particularly from about 200° F. to about 250° F. After being heated, if desired, the textile materials can then be rinsed.

In order to dye the textile materials after treatment with the amine oxide, the materials can be dipped into a dye bath containing an anionic dye. In general, any suitable anionic dye may be used. In one embodiment, the dye bath can contain a salting agent, such a metal salt, that facilitates exhaustion of the dye to the textile material. Such salting agents have been used in the past. However, it has been discovered by the present inventors that less salting agent is required to achieve the required shade if the textile materials have been previously contacted with an amine oxide. For instance, a salting agent can be present in the bath at a concentration of less than about 120 grams/liter, and particularly from about 5 grams/liter to about 120 grams/liter.

Other objects, features and aspects of the present invention are discussed in greater detail below.

DETAILED DESCRIPTION OF PREFERRED EMBODIMENTS

The present invention is generally directed to a process for treating textile fibers namely cotton, cellulosics, wool, nylon and polyester fibers, in order to make them more receptive to dyes. More particularly, it is believed in the case of cotton and cellulosics, the process of the present invention increases the cationic charge of the cellulosic materials making them have a greater affinity for anionic dyes. In this manner, less dye and salt is required when dyeing the materials. The process of the present invention generally includes the step of contacting the cellulosic materials with an amine oxide. The amine oxide we believe chemically reacts with the cellulosic material causing the cellulosic material to have an increased cationic charge.

In the past, amine oxides have been used in order to dissolve cellulose from wood and other sources and then form cotton-like fibers from the dope after extrusion into water, which is a solvent for the amine oxide but not for the cellulose.

As opposed to the above prior art, in one embodiment, the present invention is directed to treating cotton fibers with amine oxides without substantially dissolving the fibers. It is believed the mechanism in the case of cotton is that the amine oxide increases the cationic charge of the fibers increasing their affinity for anionic dyes. Besides minimizing the amount of dye used to dye cotton fibers and other cellulosic materials, the process of the present invention offers many other advantages and benefits.

For instance, the present inventors have discovered that dead cotton contained within fabrics will react with the amine oxide making the dead cotton capable of receiving dyes. In the past, fabrics made with dead cotton were considered inferior in that the dead cotton would not dye to the same extent as the other cotton fibers and would leave light spots on the resulting fabric. The process of the present invention, however, can be used to overcome the disadvantages associated with fabrics containing dead cotton.

In certain circumstances, the process of the present invention can also remove pilling on fabrics containing cotton fibers. For example, the amine oxide can be used to plasticize the fine fibrils that cause pilling. The treated fibrils will then weld to other fibers contained in the fabric.

Because it has been discovered that some amine oxides plasticize cellulosic materials while others will not, the process of the present invention can also be engineered to create a fabric having particular desired hand characteristics. Specifically the hand characteristics of a fabric can be controlled by selecting particular amine oxides for use in the process and by controlling the concentration of the amine oxides in the solution that is contacted with the fabric.

Various other advantages and benefits of the present invention will be made apparent from the following description.

The following is one embodiment of a process according to the present invention for treating cellulosic materials for increasing their affinity to dyes. The following description will be primarily directed to fabrics containing cotton fibers. It should be understood, however, that the process of the present invention is also applicable to treating fibers themselves, to yarns made from the fibers, or to other textile materials, such as wool, nylon and polyester or mixtures of said fibers. The mechanism in the case of the other fiber types is believed to be based on the "super solvent" characteristics of the amine oxide water combination causing the fibers so treated to be less crystalline and more amorphous. Further, although the following description will discuss treating cotton fibers, the process of the present invention can also be used to treat other cellulosic materials such as wool.

As described above, in general, the process of the present invention is directed to treating cotton, cellulosics, wool, nylon and polyester fibers contained in fabrics with one or more amine oxides. The fabric treated in accordance with the present invention can also be a blend of fibers. For instance, it is believed that the process can be used advantageously to dye fabrics containing a mixture of cotton and polyester fibers.

Various amine oxides can be used in accordance with the present invention for treating textiles. For instance, amine oxides that dissolve or plasticize cellulosic materials and amine oxides that do not dissolve or plasticize cellulosic materials can both be used. In one embodiment, an amine oxide can be used that has the following formula:

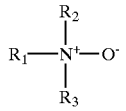

where $R_1$, $R_2$ and $R_3$ are $C_1$ to $C_8$ linear or branched alkane radicals or hydroxyalkyl groups.

$R_1$ and $R_2$ can be linked to form five and six membered heterocyclic rings.

$R_1$, $R_2$ and $R_3$ can be the same or different.

Particular examples of amine oxides that dissolve cellulosic materials include N-methylmorpholine oxide, and N,N-dimethylethanolamine oxide.

The present inventors discovered various amine oxides that do not dissolve cellulosic materials. To the inventors' knowledge, all amine oxides used in the past to treat cellulosic textiles dissolved and plasticised the materials. Amine oxides, however, that generally do not dissolve cellulosics include trialkylamine oxides, such as trimethylamine oxide. The use of amine oxides that do not dissolve cellulosic materials offer various benefits and advantages in certain applications. For instance, if the amine oxide were to dissolve or plasticize the cotton fibers, the resulting fabric would become stiffer. Using amine oxides that do not dissolve or plasticize the cotton fibers results in fabrics having a softer hand.

In order to apply the amine oxide to the textile materials, various methods and processes can be used. For instance, the amine oxide can be sprayed or printed onto a fabric. In an alternative embodiment, the fabric can be dipped into an aqueous solution containing an amine oxide.

For instance, in this embodiment, one or more amine oxides can be combined with water. The amine oxides can be present in the aqueous solution in an amount from about 20% to about 50% by weight. The amine oxide can be added to the aqueous solution as a preformed composition or can be added to the solution as separate reactants that later form an amine oxide. For instance, a tertiary amine and hydrogen peroxide can be added to the solution which will then form the amine oxide.

Although not necessary, the aqueous solution containing the amine oxide can contain other ingredients if desired. For instance, the aqueous solution can contain surfactants, wetting agents, thickening agents and/or deaerating agents. The solution can be pH adjusted with common acids and bases.

Once the aqueous solution is formed containing the amine oxide, a fabric containing cotton fibers is dipped into the solution and the solution is padded onto the fabric. The temperature of the solution will vary depending upon the ingredients contained within that solution. For most applications, however, the solution need only be at room temperature.

The add on rate to the fabric will also vary depending upon the particular application. Such factors to consider are the concentration of the amine oxide in the aqueous solution, how much stiffening of the fabric is desired if the solution contains an amine oxide that plasticizes cellulosic materials, the shade of dye that is to be used, plus various other factors. For most applications, however, the add on rate will be such that the fabric increases in weight after being dipped into the solution in an amount from about 50% to about 120%, and particularly from about 50% to about 75%.

Once the amine oxide is applied to the fabric, the fabric is heated in order to substantially dry the fabric and to ensure the amine oxide has plasticized or reacted with the cotton fibers. To ensure uniformity of the treatment throughout the fabric, the fabric should be substantially dry. During the drying cycle, the fabric will reach the optimum amine oxide content (typically 9–12%) for optimum performance. For instance, the fabric can be heated to a temperature of from about 1400 F. to about 300° F., and particularly from about 200° F. to about 250° F. In general, lower temperatures require longer drying times. In one embodiment, the treated fabric is concentrated by being contacted with steam. We believe that there is an optimum high concentration of amine oxide in water that is the most effective concentration with some water being important for efficient use of the amine oxide.

After being heated, the fabric can then be rinsed with water in order to remove any unreacted materials. In general, the fabric can simply be rinsed with water or with water containing a surfactant or soap.

After being rinsed, the fabric is then ready to be dyed. For most applications, in order to dye the cotton fabric, the fabric will be immersed in a dye bath containing one or more anionic dyes. In general, any suitable dye may be used in the present invention including sulfur dyes, direct dyes, fiber reactive dyes, vat dyes (indigo), and the like.

Besides containing one or more dyes, the cotton dye bath can contain various other ingredients. For instance, in one embodiment, the dye bath will contain a salting agent that facilitates application of the dye to the fabric. Specifically, the salting agent when present in the dye bath shields the cotton negative charge and makes the dye less soluble so that the dye can be absorbed onto the fabric. Salting agents that may be used according to the present invention include various metal salts, such as sodium salts. Particular salting agents include sodium chloride or sodium sulfate.

These salting agents have been used in the past in dyeing processes. It has been discovered by the present inventors, however, that smaller amounts of salting agents are needed when cotton fabrics have been treated with an amine oxide in accordance with the present invention. Specifically, better results are obtained with 30 to 50 percent less salting agents. In this regard, the salting agents can be present in the dye bath at a concentration of up to about 120 grams/liter, and particularly at a concentration of less 100 grams/liter. More particularly, the salting agents can be present within a dye bath in an amount from about 5 grams/liter to about 100 grams/liter. Such a reduction in salt results in a significant and beneficial reduction in dye-bath wastes.

Besides salting agents, various other ingredients can also be present in the dye bath. Such other ingredients include lubricants, softeners, wetting agents, pH adjusters, and buffers.

In an alternative embodiment of the present invention, instead of applying the amine oxide to the fabric by dipping the fabric into a solution, a composition containing the amine oxide can be printed onto the fabric. In this embodiment, the amine oxide can be combined with a thickener to form a print paste. Thickeners that can be used, for instance, include gums or well known acrylic thickeners like the cross-linked polyacrylic acid types.

Once the print paste is formed, the paste can then be printed onto the fabric using, for instance, a gravure printing device. The amine oxide composition can be applied uniformly to a surface of a fabric or can be applied to the fabric according to a predetermined pattern. If applied according to a predetermined pattern, once the fabric is dyed, the pattern will become visible. Specifically, the areas of the fabric treated with the amine oxide composition will have a darker shade than the remainder of the fabric. Through this process, various unique and aesthetic fabrics and dye patterns can be formed.

In still another alternative embodiment of the present invention, an amine oxide composition can be used to emboss a design into a fabric containing cellulosic fibers. In this embodiment, the fabric is treated as described above with an amine oxide that readily plasticizes cotton such as NMMO or DMHEAO. Once treated, a heated stamp is pressed into the fabric according to a desired design. The temperature and pressure of the stamp will cause cellulosic fibers contained in the fabric to plasticize and bond together. The area of the fabric contacted with the stamp thus becomes stiffer than the remainder of the fabric. In this manner, a design can be embossed into the fabric much like a watermark on a paper product. Further, once the fabric is dyed, the embossed pattern will have a darker shade.

As described above, besides cellulosic materials, the process of the present invention can also be used to facilitate dying other textile materials, such as wool, nylon and polyester. In this embodiment, it is believed that the amine oxide acts as a solvent and is absorbed into the textile material. In this manner, the textile material has a greater affinity for dyes. Thus, when dying textile materials such as wool, nylon and polyester, the amine oxide chosen for the process is preferably an amine oxide that has solvent-like qualities. For instance, preferably an amine oxide is used having a relatively low molecular weight.

The present invention may be better understood with reference to the following examples.

EXAMPLE NO. 1

This experiment demonstrates that appropriate treatment of cotton fabric with a selected amine oxide will temporarily plasticize the surface of the cotton fibers without significantly altering their original fibrous characteristics.

Fabric: 100% Cotton Sheeting

Procedure:

1) Apply a 50% solution of N-methyl morpholine oxide by expression-nip techniques to a wet-pick-up of 60–70%.
2) Dry the fabric at 300° F. until completely dry.
3) Cut the sample into a portion which will be washed and one which will remain unwashed.
4) Compare the effects of the treatments by examining the fabrics using SEM techniques.

A comparison of the highest magnification pictures of the untreated and treated fabrics shows that the basic fibrous character of the fabric is not altered by the amine oxide treatment but that the surfaces of the individual fibers have, however, been plasticized and re-solidified. This is evidenced by some of the adjacent fibers in the treated pieces being bound together at various points by what appear to be narrow strips of plastic films that were not present in the untreated fibers.

In the untreated fabrics, all the fibers are separate and distinct with surfaces that are smooth except for isolated abraded areas. We believe that the fibers are pressed very close together under the pressures of the expression-nip application technique and that as the water is evaporated from the amine oxide solution during drying, the amine oxide dissolves into the surface of the fibers causing the surfaces to be soft and deformable and somewhat tacky. The surfaces of adjacent fibers that are touching each other would then dissolve into each other at the points of contact, leaving the fibers joined at those points. When the amine oxide is removed by washing, the fiber surfaces re-harden to their original consistency.

In a subsequent step to this work we verified by Kjeldahl methods that the amine oxide is indeed deposited on the fabric by the process but is completely removed by the post-rinse step. The final washed fabrics show 0.00% nitrogen.

EXAMPLE NO. 2

Experiment No. 1

This experiment demonstrates that the plasticization of cotton fibers, caused by the fabric treatments similar to that used in experiment 1, imparts unexpected characteristics to the fabric that are of benefit to textile designers and manufacturers.

In this experiment, specific areas of fabrics were treated with amine oxide by applying the amine oxide by screen printing techniques. The samples were then overdyed, whole, with direct dyes. Examination of the resulting fabrics reveals that the areas that received the amine oxide treatments are much darker than the areas that did not receive treatment. This means that cotton fibers treated with amine oxide are more open and interact with dyes in different ways do fibers that are not treated with amine oxide.

Fabric: 100% cotton 80×80 print cloth

Procedure:

1) A print paste of amine oxide is generated using a trace of acrylate (Acrysol TT615 from Rhom and Haas) as a thickener in a 50% solution of amine oxide in water. This paste is applied to the print cloth by using screen print techniques and the resulting colorless fabric is dried at 160° F.–180° F. and heated further for 1 minute at 300° F. The amine oxide used was N-methylmorpholine oxide Manufactured by BASF.
2) The fabrics created in step 1 were then rinsed with hot water, scoured at 120° F. and re-rinsed with hot water and dried. They were subsequently overdyed with direct dyes at a liquor ratio of 10:1 according to the formulas shown below:

| CHEMICALS | UNITS | RUN 1 | RUN 2 | RUN 3 |
|---|---|---|---|---|
| Intralite turquoise blue GRLL (dye) | % OWF | 3.0 | 3.0 | |
| Intralite Blue 2RLL (dye) | % OWF | | | 2.0 |
| Common Salt | % OWF | 80.0 | 80.0 | 30.0 |
| Unmercerized Cotton | | X | | |
| Mercerized Cotton | | | X | |
| Cotton Sheeting | | | | X |

Dyes applied by immersing the fabrics in the above baths at 210° F. for 20 minutes followed by rinsing and drying.

As stated above, after dyeing, the screen printed pattern applied to the fabrics was visible. In particular, the screen printed pattern was darker in shade than the remainder of the fabric.

EXAMPLE NO. 2

Experiment No. 2

This experiment demonstrates that treating a fabric with an appropriate amine oxide will cause cotton fabrics to accept reactive dyes in such a way that the resulting fabrics will be darker versus untreated fabric. This translates into a higher dye yield. This experiment involved pretreating 100% cotton fabrics with N-methylmorpholine oxide in two ways: by screen printing and by expression-nip (pad), and then overdyeing the fabrics with reactive dye solutions.

The procedure for the pre-printing of the fabrics was as follows:

1) Prepare a print paste of: 95 parts 50% N-Methylmorpholine oxide (BASF) 5 parts Acrysol TT 615 (Rohm and Haas)
2) Apply the paste in a strip to a fabric by squeezing the mix through a screen using a hand-held press.
3) Dry one sample "A" in a horizontal laboratory oven at 200° F. for 2 minutes.
4) Dry another sample, "B" at 300° F. for 3 minutes. This simulates a simultaneous dry and cure.
5) Rinse both pieces with hot water (120° F.–140° F.).
6) Scour both pieces with a solution that contains 2% Tanaterge RTD at 120° F. for 10 minutes.
7) Rinse both pieces, again, using hot water (120°–140° F.).
8) Dye both pieces.

The procedure for pre-treating the fabric with expression-nip (pad) techniques is as follows:

1) Prepare a solution that is 30% amine oxide (50% N-methylmorpholine oxide from BASF).
2) Warm the solution to 100° F. and dip fabric samples into it and pass the samples through expression-nip rollers to a wet-pick-up of 100%.
3) Dry one sample "A" at 200° F. for 2 minutes.
4) Dry another sample "B" at 300° F. for 3 minutes.
5) Rinse, then scour, then rinse these samples as in steps 5, 6, and 7 of the printing procedure above.
6) Dye the samples.

Dyeing Procedure:

Fabric: 100% Cotton 80×80 print cloth

Dyeing procedure: liquor ratio 10:1

Equipment: Ahiba bench-top lab dye equipment

1) Set bath at 80° F. with dye and salt in the amounts shown below.
2) Add soda ash and run for 10 minutes.
3) Add sodium hydroxide. and run five minutes.
4) Raise temperature to 140° F. and run 45 minutes.
5) Rinse hot. Scour at 180° F.–200° F. Rinse warm. Dry.

| CHEMICALS | UNITS | RUN 1 | RUN 2 | RUN 3 | RUN 4 | RUN 5 |
|---|---|---|---|---|---|---|
| Remazol Yellow 4GL 150% (dye) | % OWF | 1 | 1 | 1 | 1 | 1 |
| Remazol Blue BB 133% (dye) | % OWF | 2 | 2 | 2 | 2 | 2 |
| Na2SO4 | Gram/L | 60 | 60 | 60 | 60 | 60 |
| Na2CO3 | Gram/L | 5 | 5 | 5 | 5 | 5 |
| NaOH (50%) | Gram/L | 2 | 2 | 2 | 2 | 2 |
| Untreated Fabric | | X | | | | |
| Printed Fabric "A" drying | | | X | | | |
| Printed Fabric "B" drying | | | | X | | |
| Exp-nip fabric "A" drying | | | | | X | |
| Exp-nip fabric "B" drying | | | | | | X |

It was discovered that regardless of how the amine oxide is applied, wherever it contacts the fabric the dyeing is darker. In runs 3 and 4, the printed areas, which had the amine oxide, are darker than the surrounding background which had not been treated. In runs 4 and 5, the pretreated fabrics are darker than the untreated sample that was dyed with the same procedure.

Close inspection of runs 1, 4A and 5B also reveal that cotton fibers that ceased growing at an immature state, referred to as "dead cotton", which are inherent in this particular fabric, are visible as small white spots in the untreated piece. They are not visible in the treated pieces, however. We believe that the amine oxide opens the "dead cotton" so that it will receive dyes as well as the rest of the fabric. Standard AATCC II A wash tests as well as wet and dry crock tests were equal on both treated and untreated dyeings.

EXAMPLE NO. 2

Experiment No. 3

In this experiment, 100% cotton fabrics were pretreated with solutions of varying concentrations of the N-methylmorpholine oxide and then dried at various temperatures and times. The oxide solutions were applied using expression-nip techniques to a wet-pick-up of about 75%, and all the samples were thoroughly rinsed after drying to remove all residual amine oxide.

Fabric: 100% Cotton 80×80 Print Cloth

Pre-application of Amine-oxide

1) Mix water and amine oxide at the percentages shown below and warm to 100° F.
2) Apply to fabric samples by expression-nip (pad) techniques to a wet pick up of 75%.
3) Dry for 90 seconds at each of three temperatures:
   A=250° F.
   B=275° F.
   C=300° F.
4) Rinse well in tap water
5) Dye with Direct Blue 80

| Level of oxide in pre-pad bath | Units | Run 1 | Run 2 | Run 3 |
|---|---|---|---|---|
| 20 | % OWB | X | | |
| 25 | % OWB | | X | |
| 30 | % OWB | | | X |

Fabric: 100% Cotton 80×80 Print Cloth

Pre-application of Amine-oxide

1) Mix water and 50 parts N-methylamorpholine oxide and warm to 100° F.
2) Apply to fabric samples by expression-nip (pad) techniques to a wet pick up of 75%.
3) Dry for 3 minutes at the temperatures specified in the table below.
4) Rinse well in tap water.
5) Dye with Direct Blue 80.

| Temperature of drying | Units | Run 4 | Run 5 | Run 6 |
|---|---|---|---|---|
| 140 | ° F. | X | | |
| 150 | | | X | |
| 160 | | | | X |

Inspection of the samples reveals that the higher the drying temperature in the pretreatment step, the darker the shade achieved during the post-dyeing. It will also be noted that, when samples were treated with various levels of oxide, but were all exposed to the same drying temperatures, that the higher the level of oxide, the darker the resulting shade was as well.

EXAMPLE NO. 2

Experiment No. 4

In this experiment, 100% cotton 80×80 print cloth was pretreated with an N-methylmorpholine oxide solution that had the following composition:

| | |
|---|---|
| N-methylmorpholine oxide (50% active standard | 60% |
| Water | 40% |

This solution was warmed to 100° F. and applied by expression-nip techniques to the fabric at a wet-pick-up of 100%. The fabrics were then dried at 250° F. for 1.5 minutes and then rinsed with hot tap water. Samples of treated fabrics were then dyed, along with untreated controls at 210° F. for 45 minutes. Rinse cold.

Fabric: 100% cotton 80×80 print cloth

Pad bath: 60 parts 50% N-methylmorpholine oxide solution, 40 parts water

Pad procedure:

1 ) Pad at 100° F. to 100% wet-pick-up.
2) Dry at 250° F. 1.5 minutes.
3) Rinse hot.

Dye with direct dyes and salt as shown below:

| CHEMICAL | UNITS | 1 | 2 | 3 | 4 | 5 | 6 | 7 | 8 | 9 | 10 | 11 | 12 |
|---|---|---|---|---|---|---|---|---|---|---|---|---|---|
| Intralite Blue 2RLL (dye) | % OWF | 2 | 2 | 2 | 2 | 2 | 2 | — | — | — | — | — | — |
| Intralite Turquoise Blue GRLL (dye) | % OWF | — | — | — | — | — | — | 3 | 3 | 3 | 3 | 3 | 3 |
| Common Salt | % OWF | 30 | 20 | 10 | 30 | 20 | 10 | 80 | 60 | 40 | 80 | 60 | 40 |
| Pre-treated fabric | | X | X | X | — | — | — | X | X | X | — | | — |
| Not pretreated | | — | — | — | X | X | X | — | — | — | X | X | X |

Typically, substantial levels of salt are required to dye fabrics with direct dyes such as are used in this experiment. Observations of the samples reveal that any given shade depth can be obtained on a pretreated fabric using one-half to two-thirds the amount of salt required for the untreated fabric.

EXAMPLE NO. 2

Experiment No. 5

This example is a demonstration of the effect of N-methylmorpholine oxide pretreatment on the ability of a fabric to allow dyes to migrate. Migration, the ability of a dye to move through the fiber bundle, is related to the ability of the dye to remain in equilibrium between water and fabric long enough to become evenly distributed among the fiber bundles. A dye that migrates easily "strikes" (exhaust to the fiber) slowly and gives a very uniform shade to the fabric. A dye that migrates well also requires a substantial amount of salt in the dyebath.

As will be outlined below, pretreatment with amine oxides seems not to disturb the natural tendency of the dyes to migrate or not to migrate, as the case may be. To demonstrate this effect, samples of 100% cotton 80×80 print cloth were pretreated with N-methylmorpholine oxide. These pretreated samples, as well as samples of untreated fabrics, were subsequently dyed using direct-dyes, one set with slow striking Class "A" direct dyes and one set with fast striking Class "C" direct dyes. Pretreated and non-pretreated dyed samples were then placed in "blank" baths along with samples that had not been dyed. Each "blank" bath contained a dyed and an undyed swatch and the appropriate amount of salt. These "blank" baths were the same compositions as the original dye baths except the dyes were omitted.

Under the conditions of these blank dyeings, dyes were free to migrate or form an equilibrium between the fabric and water and become redistributed through the fiber bundles. The greater the tendency of the dye to migrate, the more dye will appear on the previously undyed swatch under the conditions of the test.

Fabric: 100% cotton print cloth

Pre-treatment:

1) Dilute a 50% solution of N-methylmorpholine oxide to 40% active with tap water.
2) Warm the solution to 100° F.
3) Apply the solution to fabric samples to a wet-pick-up of 65%.
4) Dry the samples at 250° F. for 90 seconds in a horizontal laboratory Benz oven.
5) Rinse the samples in hot tap water.

Dyeing of pretreated samples:

1 ) Set bath temperature at 100° F. with fabric and dye.
2) Run 10 minutes.
3) Add the common salt detailed below while raising the temperature to 210° F.
4) Run at 210° F. for 45 minutes and then rinse in cold tap water.

For migration test:

1) Add equal weights of dyed and undyed samples to a dyebath made as above containing a salt, but not containing any dye.
2) Run the blank dyebath as above, then remove the samples and rinse them.
3) Dry at low temperature and observe the dye transfer onto the white pieces.

| CHEMICALS | UNITS | 1 | 2 | 3 | 4 | 5 | 6 |
|---|---|---|---|---|---|---|---|
| Intralite Red 5B Ext. Conc. (Group "A" dye) | % OWF | 2 | | 2 | | 2 | |
| Superlite Fast Blue Rubine WLKS (Group "C" dye) | 5 OWF | | 2 | | 2 | | 2 |
| Common Salt | g/l | 40 | 20 | 25 | 10 | 40 | 20 |
| Pretreatment | | yes | yes | yes | yes | | |

Observation of the samples reveals that, as in earlier experiments, the amine oxide pretreatment yields, 1) a darker shade when the same amount of salt is present in the dyeings, and, 2) an equivalent shade when the level of salt used in the dyeing of the treated samples is reduced by nearly half. It was also observed that the white specks in the non-pretreated piece which are due to immature or dead cotton fibers are not observed in the pretreated pieces, reinforcing the idea that the amine oxide pretreatment makes the immature cotton accept dyes as readily as normal cotton.

Inspection of each pair in the migration test indicates that within each dye type, the ability of the dye to migrate or not to migrate, as the case may be, is not damaged by the amine oxide pretreatment. In reality, the migration capability seems not to be moderated at all by amine oxide treatment.

EXAMPLE NO. 2

Experiment No. 6

This experiment demonstrates that treatment of cotton fabrics with amine oxide will reduce the surface fibrulation that occurs during processing. 100% cotton print cloths were treated with 3 different treatments. Sample 1 had no oxide treatment. Sample 2 was pre-treated with N-methylmorpholine oxide as follows: 1) a 50% solution of oxide was applied at a 60–65% wet-pick-up by expression-nip techniques; 2) the resulting fabric was dried for 90 seconds at 240 deg F. in a horizontal lab oven, and, the sample was then rinsed. Sample 3 was mercerized.

The samples were folded so that the small fibrils extending out from the surface of the fabric would be very visible against a dark background. Observation of the photographs reveals that the number of fibers on the surface of the sample treated with amine oxide is less than the number of fibers on the surfaces of either the untreated sample or the mercerized sample.

EXAMPLE NO. 2

Experiment No. 7

This experiment demonstrates that cellulose fibers other than 100% cotton are affected by pretreatment with amine oxide in essentially the same way as the cotton in that the same level of dye yield deeper shades on pretreated fabrics.

Rayon and cellulose acetate fabrics were pretreated with N-methylmorpholine oxide as described in Example No. 5 above. Subsequently, the rayon was dyed with Direct Red 79 and the cellulose acetate was dyed with Disperse Yellow 42. Both were dyed using procedures accepted in the industry of those dyes.

In the case of the red rayon, the shade of the pretreated piece is much deeper than for the non-pretreated piece. The shade difference is not as exaggerated in the yellow acetate. However, in both cases, the fabrics which had been pretreated are much stiffer to the touch than are the ones that were not pretreated.

EXAMPLE NO. 2

Experiment No. 8

This experiment studies the ability of amine oxides to give a "memory" for shapes to 100% cotton.

In this experiment, two samples were produced. In the first, a mixture of 80 parts N-methylmorpholine oxide (97%) and 20 parts water was applied in a stripe to a piece of pre-dyed 100% cotton 3×1 twill fabric "bottomweight" or workwear-weight fabric. The fabric was then folded so that there was a crease running down the middle of the amine oxide stripe. The fabric was then pressed in the folded state between two heated plates for 30 seconds at 300° F. The crease was set into the fabric at that point. The fabric was then washed with a household detergent 5 times and the crease was still visible, unchanged from the original configuration. The "memory" of the crease is permanent.

The second sample demonstrates the ability of a treated fabric to "remember" the shape of an embossing procedure. The fabric, in this case, is a 100% cotton plain weave fabric. A relatively large area of the fabric was coated with the 80 parts N-methylmorpholine oxide (97%)/20 parts water mixture used above. The fabric was pressed into a metal cap of a Y3 glass jar with a round metal dye preheated to 300° F. and kept in contact with the fabric for 30 seconds. Then the set fabric was washed 5 times under home wash conditions. At the end of the washing and drying, the imprint of the jar lid was still very clear. This fabric, also, had a permanent memory of a shape.

EXAMPLE NO. 2

Experiment No. 9

This experiment illustrates the effect of N-methylmorpholine oxide pre-treatment on the shades obtained from sulfur black dyes on 100% cotton fabric.

The details of the chemistries and procedures are outlined in below.

Fabric: 100% cotton printcloth

Pretreatment:

1) Pad at 100° F. and w.p.u. 65%.
2) Dry at 250° F. for 90 seconds.
3) Rinse hot—Dye as below.

Dyeing:

1) Set bath at 100° F. with water and dye—run 10 minutes
2) Add salt in three portions over 15 min., then add reducing sugar and run 5 minutes.
3) Raise temperature to 160° F. Add ½ soda ash and run 5 minutes. Add ½ soda ash run another 5 minutes.
4) Raise temperature to 200° F. and run 30 minutes. Rinse cold.

Oxidation:

1) Refill with water and add 0.5% acetic acid (56%) and 1.5% hydrogen peroxide (35%).
2) Set bath temperature at 120° F. and run 10 minutes.
3) Scour at 150° F. with 1.0% Tanaterge RE and 1.0% soda ash for 15 minutes.
4) Rinse.

| CHEMICALS | UNITS | 1 | 2 | 3 | 4 | 5 | 6 | 7 | 8 |
|---|---|---|---|---|---|---|---|---|---|
| (Pad bath) | | | | | | | | | |
| N-methylmorpholine oxide 50% | % OWB | 40 | 40 | 40 | 40 | | | | |
| (Dye bath) | | | | | | | | | |
| Sandoz Sulfur Black 4G-RDT | % OWF | 10 | 12 | 14 | 16 | 10 | 12 | 14 | 16 |
| Sodium Sulfate | % OWF | 35 | 35 | 35 | 35 | 35 | 35 | 35 | 35 |
| (Reducing Sugar) | % OWF | 8 | 8 | 8 | 8 | 8 | 8 | 8 | 8 |
| Sandoz Reducer RDT pdwr | | | | | | | | | |
| (Oxidation) | % OWF | | | | | | | | |
| 56% acetic acid | % OWF | 0.5 | 0.5 | 0.5 | 0.5 | 0.5 | 0.5 | 0.5 | 0.5 |
| 35% peroxide | % OWF | 1.5 | 1.5 | 1.5 | 1.5 | 1.5 | 1.5 | 1.5 | 1.5 |
| (Scour) | | | | | | | | | |
| Tanaterge RE | % OWF | 0.5 | 0.5 | 0.5 | 0.5 | 0.5 | 0.5 | 0.5 | 0.5 |
| Soda Ash | % OWF | 1.0 | 1.0 | 1.0 | 1.0 | 1.0 | 1.0 | 1.0 | 1.0 |

Sulfur black dyes are pigments that are formed in-situ within the fiber and are substantive to the fibers but are not reacted with them. The samples revealed that the shade builds to a darker and darker shade as more and more dye is added. With some procedures, however, the shade will reach an intermediate depth and not become darker regardless of how much more dye is added.

Also indicated was that whatever shade is desired can be achieved on pretreated fabrics using only about ⅔ the level of dye required by fabrics that were not pretreated.

EXAMPLE NO. 3

Experiment No. 1

This set of experiments compares amine oxides of various structures and molecular weights in terms of their effect on dye yield.

The oxide of N-methylmorpholine was used as the standard for comparing dye yields.

These additional oxides were generated in the lab by reacting the required amine with a commercial 35% solution of hydrogen peroxide so that the amine and peroxide were used in a mole ratio of 1.0 moles of amine to 1.1 moles of peroxide.

The procedure was, generally, as follows:

1) Pre-calculate the amount of water that will be required, over and above the amount added with the peroxide, to yield a solution that is about 50% active.
2) Add the required amount of amine to the reactor, along with about 1.5% of EDTA (as Hampene 100), and the water calculated in step 1.
3) Heat the mixture to 67° C.
4) Add the 35% hydrogen peroxide over a four hour period, allowing any exotherm to take place without cooling.
5) Continue mixing at about 70° C. for 2 additional hours.
6) Remove heat and cool to room temperature.

The amine oxide contents and the free, unreacted amine contents of these reaction mixtures were then determined by reacting the samples with acetic anhydride and then titrating them with perchloric acid dissolved in acetic acid. The residual peroxide contents were determined by a standard procedure of potentiometric titration with potassium permanganate.

The final mixtures were adjusted to 50% active and applied to 100% cotton fabrics, as pre-treatments, by the procedure described in Example No. 5.

These fabrics were then dyed as in Example No. 5, and the yields determined, both visually and by ACS Color Eye.

The additional amine oxides are listed below, along with the dye yields:

| | |
|---|---|
| N-methylmorpholine oxide (standard) | 100 |
| N-(2hydroxyethyl)morpholine oxide | 99 |
| N,N-dimethylethanolamine oxide | 110 |
| N-ethylmorpholine oxide | 104 |
| N,N-dimethyloctylamine oxide | 99 |
| Visually Estimated | |

Using the differences in dye-yield as indicators of differences in the capabilities of the different oxides to modify the surface of a cotton fiber, N-methylmorpholine oxide is not the most effective. Other amine oxides that are more effective in increasing dye yields include the oxide of N,N-dimethylethanolamine, which plasticizes the fiber surface and stiffens the fabric.

EXAMPLE NO. 3

Experiment No. 2

In this experiment 100% Cotton print-cloth fabric was treated with 40% (owb) solutions of N-methylmorpholine-oxide and trimethylamine-oxide. The oxide solutions were applied by expression-nip technique at 100° F. and a wet-pick-up of 65%. The fabric then dried at 250° F. for 90 seconds, and rinsed with hot tap water to remove all residual amine-oxide.

A control of untreated cotton and the above treated samples were dyed as follows:

Liquor Ration 10:1

Dyes:

4% (owf) Remazol Black B 1.28% (owf) Remazol Golden Yellow RNL liquid 25%

1.6% (owf) Remazol Red RB

1. Set dyebath at 80° F. with all dyes—wetout 5 minutes.
2. Add: 50 g/L $Na_2SO_4$—run 10 minutes.
3. Add: 2 g/L Alkaflo LSA—run 15 minutes
4. Add: 3 g/L Alkaflo LSA—run 5 minutes.
5. Raise temperature to 140° F.—run 45 minutes. Rinse—soap—rinse—dry. Results of dye yields measurements by ACS—Color Eye are listed in the following tables.

| DYES | UNITS | 1 | 2 | 3 |
|---|---|---|---|---|
| Remazol Black B | % OWF | 4 | 4 | 4 |
| Remazol G Yellow RNL Liquid 25% | % owf | 1.28 | 1.28 | 1.28 |
| Remazol Red RB | % owf | 1.6 | 1.6 | 1.6 |
| $Na_2SO_4$ | g/l | 60 | 60 | 60 |
| Alkaflo LSA | g/l | 5 | 5 | 5 |
| Untreated Fabric (Standard) | — | X | | |
| Treated w/N-methylmorpholine-oxide | % owb | | 40 | |
| Treated w/trimethylamine-oxide | % owb | | | 40 |
| ACS | | 100 | 106 | 116 |

As indicated by ACS readings both amine-oxides produced considerably deeper dyeings than the untreated sample. However, the treatment with w/trimethylamine-oxide has superior yield not only to the untreated sample, but also outperformed the N-methylmorpholine-oxide as well. In the addition to the better yield is that the sample treated with trimethylamine-oxide has a pleasing soft hand versus the stiff hand of the sample treated with N-methylmorpholine-oxide.

EXAMPLE NO. 4

The following example was completed in order to demonstrate that wool products can also be treated in accordance with the present invention. Specifically, 100% wool gabardine fabric samples were pretreated with trimethylamine oxide and then dyed.

The amine oxide solution contained 40% by weight (OWB) of trimethylamine oxide and 60% by weight water. This solution was padded onto the samples at 100° F. at a wet pickup rate of 55%. The fabrics were then dried at 225° F. for 3 minutes and rinsed with hot water.

Treated samples and untreated samples were dyed together in the following dye baths:

1) 3.0% Intracid yellow 2G (level dying acid dye), 1.0% MIGRASSIST WWB (leveling agent), water, and formic acid in an amount sufficient for the bath to have a pH of 3.0
2) 4.0% Polar Br. Red 3BN 140% (fast milling acid dye), 1.0% MIGRASSIST WWB, and MSP added in an amount sufficient for the bath to have a pH of 6.0
3) 2.0% Irgalan Grey GL 200% (2:1 metal complex dye), 1.0% MIGGRASSIST WWB, 5.0% ammonium sulfate
4) 4.0% Neolan Blue PA (1:1 metal complex dye), 3.0% TANALEV WOL (leveling agent), and formic acid added to the bath in an amount sufficient for the bath to have a pH of 3.2

From a visual inspection, it was observed that the fabrics treated in accordance with the present invention dyed quicker and to a darker shade.

EXAMPLE NO. 5

The following example was carried out in order to demonstrate that the process of the present invention is applicable to treating nylon materials. Specifically, 100% nylon 6,6 fabric samples were treated with various amine oxide solutions and then dyed. The amine oxide solutions used in the example included:

1) Untreated samples
2) 50% (OWB) methylmorpholine oxide solution
3) 30% (OWB) trimethylamine oxide solution; and
4) 40% (OWB) trimethylamine oxide solution Each of the above solutions were heated to 100° F. and padded on the fabric samples at a wet pickup rate of 65%. The fabrics were then dried at 250° F. for 5 minutes and rinsed with hot water.

All of the samples were then dyed in a dye bath containing 3.0% (OWF) Polar BR Red 3BN at 140%, and 5.0% (OWF) ammonium sulfate. The samples were placed in the bath for 10 minutes. The temperature of the dye bath was 212° F.

After being dyed, it was observed that the fabric samples treated with an amine oxide dyed faster and had a darker shade than the untreated sample. The fabric sample treated with 40% trimethylamine oxide had the darkest shade.

EXAMPLE NO. 6

The following example was completed in order to demonstrate the ability the process of the present invention to dye aramid fibers.

Fabric samples made from 100% aramid NOMEX fibers were treated with an amine oxide solution in accordance with the present invention. The amine oxide solution contained 50.8% (OWB) N,N-dimethylethanolamine oxide. The solution was heated to 100° F. and padded onto the fabric at a wet pick-up rate of from about 50 to about 60%. After being treated, the samples were placed in a microwave oven for 6 minutes and then rinsed with hot water.

Samples treated with an amine oxide as described above and untreated samples were then placed in different dye baths. Each of the dye baths contained 8.0% (OWF) TERASIL Black PRN. The dye baths, however, contained different carriers as follows:

1) No carrier;
2) 40 gr per liter of LEVEGAL C-45 available from Bayer; (Miles);
3) 20 gr per liter LEVEGAL C-45;
4) 30 gr per liter F-2007 J available from Sybron Chemical;
5) 15 gr per liter F-2007 J;
6) 20 gr per liter CAROLID NOL available from Sybron Chemical;
7) 10 gr per liter CAROLID NOL.

Normally, carriers are required when dying aramid fibers. The carrier is a solvent based solution that facilitates absorption of the dye.

Treated and untreated fabric samples were placed in dye bath Nos. 1, 2, 4, and 6 for 1 hour at 212° F. and other samples were placed in the same baths for 1 hour at 265° F. Only treated samples were placed in dye bath Nos. 3 and 5 for 1 hour at 265° F.

After being dyed, it was observed that the fabric samples treated with an amine oxide dyed quicker and had a darker shade than the untreated samples. Further, it was shown that a carrier may not be needed if the sample was treated with an amine oxide.

EXAMPLE NO. 7

The following example was conducted in order to demonstrate the ability of the process of the present invention to dye polyester materials. In this example, 100% texturized polyester fabrics were treated with an amine oxide solution and dried at different temperatures. Specifically, the samples were treated with a 40% (OWB) trimethylamine oxide solution. The amine oxide solution was heated to 100° F. and padded on the samples at a wet pick-up rate of 60%. Different sets of samples were then dried at different temperatures. Specifically, the samples were dried at either 200° F. for 5 minutes, 230° F. for 5 minutes, or 250° F. for 5 minutes.

After being dried, the samples were placed in a dye bath containing 0.75% (OWF) Palanil yellow 3GE at 200%, 1.0% (OWF) Resolin Red FB at 200%, 1.5% (OWF) Resolin Blue FB2 to produce a brown color, and 12.0% (OWF) CAROLID NO. 2 which is a carrier. The dye bath was maintained at a temperature of 212° F. The samples were placed in the dye bath for 1 hour and then rinsed with hot water. Samples treated with the amine oxide solution and untreated samples were dyed together.

It was discovered that the samples treated with the amine oxide dyed faster and to a darker shade than the untreated samples. Further, it was observed that as the drying temperature increased, the shade of the sample became darker.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for making cellulosic, wool, nylon or polyester fibers more receptive to dyes comprising the steps of:

providing said fibers;

contacting said fibers with an amine oxide, said amine oxide being present in an aqueous solution, said amine oxide increasing the dye absorptivity of said fibers;

heating said treated fibers; and contacting said fibers with a dye in a dye bath.

2. A process as defined in claim 1, wherein said fibers comprise cellulosic fibers.

3. A process as defined in claim 2, wherein said cellulosic fibers comprise cotton fibers.

4. A process as defined in claim 1, wherein said amine oxide comprises trimethylamine oxide.

5. A process as defined in claim 1, wherein said amine oxide is present in said aqueous solution in an amount from about 20% to about 50% by weight.

6. A process as defined in claim 1, wherein said fibers are contained in a fabric that is contacted with said amine oxide.

7. A process as defined in claim 1, wherein after said fibers have been contacted with said amine oxide, said fibers are heated to a temperature of from about 140° F. to about 300° F.

8. A process as defined in claim 1, further comprising the step of rinsing said fibers after said fibers have been heated.

9. A process as defined in claim 6, wherein said fibers are contacted with said amine oxide by dipping said fabric into a solution containing said amine oxide.

10. A process as defined in claim 1, wherein said fibers are contacted with said dye by being immersed into the dye bath containing said dye and a metal salt, said metal salt being present in said solution at a concentration of from about 20 grams/liter to about 120 grams/liter.

11. A process as defined in claim 6, wherein said fibers are contacted with said amine oxide by printing a composition containing said amine oxide onto said fabric.

12. A process as defined in claim 1, wherein said dye comprises an anionic dye.

13. A process as defined in claim 1, wherein said fibers comprise wool fibers.

14. A process as defined in claim 1, wherein said fibers comprise nylon fibers.

15. A process as defined in claim 1, wherein said fibers comprise polyester fibers.

16. A process for making cellulosic fabrics more receptive to anionic dyes comprising the steps of:

providing a textile product containing cellulosic fibers;

contacting said textile product with an amine oxide without substantially dissolving said cellulosic fibers in said textile product, said amine oxide being present in an aqueous solution, said amine oxide reacting with said cellulosic fibers in said textile product for increasing the cationic charge of said fibers;

heating said textile product;

dying said textile product in a dye bath, said dye bath containing an anionic dye and a salting agent, said salting agent being present in said bath at a concentration of less than 120 grams/liter.

17. A process as defined in claim 16, wherein said salting agent is present in said dye bath at concentration of less than 100 gram/liter.

18. A process as defined in claim 16, wherein said salting agent is present in said dye bath at concentration of less than 70 gram/liter.

19. A process as defined in claim 16, wherein said salting agent comprises a metal salt.

20. A process as defined in claim 16, wherein said salting agent comprises a sodium salt.

21. A process as defined in claim 16, wherein said amine oxide is a material, having the following formula:

wherein $R_3$ is a $C_1$ to $C_8$ linear or branched alkane radical or hydroxyalkyl group, and $R_1$ and $R_2$ are $C_1$ to $C_8$ linear or branched alkane radicals or hydroxyl groups or form a 5 to 6 membered heterocyclic ring.

22. A process as defined in claim 16, wherein said amine oxide comprises trimethylamine oxide.

23. A process as defined in claim 16, wherein said cellulosic fibers comprise cotton fibers.

24. A process for making cellulosic fabrics more receptive to anionic dyes comprising the steps of:

providing a textile product containing cellulosic fibers;

contacting said textile product with an amine oxide, wherein said textile product is contacted with said amine oxide by being dipped into an aqueous solution containing said amine oxide, said amine oxide being present in said solution in amount from about 20% to about 50% by weight, said amine oxide reacting with said cellulosic fibers in said textile product for increasing the cationic charge of said fibers;

heating said textile product;

dyeing said textile product in a dye bath, said dye bath containing an anionic dye and a salting agent, said salting agent being present in said bath at a concentration of less than 120 grams/liter.

25. A process as defined in claim 16, wherein said textile product is contacted with said amine oxide by printing a composition containing said amine oxide onto said textile product.

26. A process as defined in claim 24, wherein said aqueous solution is applied to said textile product in an amount of less than 30% by weight when said textile product is dipped into said solution.

27. A process for dyeing a pattern onto a fabric comprising the steps of:

providing a fabric, said fabric containing cotton fibers;

applying a cellulose reactive composition to said fabric according to a predetermined pattern, said composition containing an amine oxide, said amine oxide reacting with said cotton fibers for increasing the cationic charge of said cotton fibers; and contacting said fabric with an anionic dye in a dye bath, wherein said dye is attracted to said fabric where said cellulose reactive composition has been applied in a manner that makes said predetermined pattern visible.

28. A process as defined in claim 27, wherein said cellulose reactive composition further comprises a thickening agent.

29. A process as defined in claim 27, wherein said amine oxide is a material, having the following formula:

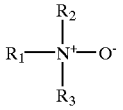

wherein $R_3$ is a $C_1$ to $C_8$ linear or branched alkane radical or hydroxyalkyl group, and $R_1$ and $R_2$ are $C_1$ to $C_8$ linear or branched alkane radicals or hydroxyl groups or form a 5 to 6 membered heterocyclic ring.

30. A process for making cotton fibers more receptive to dyes comprising the steps of:

providing cotton fibers;

contacting said fibers with an amine oxide, said amine oxide comprising trimethylamine oxide;

heating said treated fibers; and contacting said fibers with an anionic dye.

31. A process as defined in claim 30, wherein said fibers are heated to a temperature and to a time to substantially dry said fibers prior to being contacted with said anionic dye.

32. A process as defined in claim 27, wherein the composition containing an amine oxide also contains water.

* * * * *

UNITED STATES PATENT AND TRADEMARK OFFICE

CERTIFICATE OF CORRECTION

PATENT NO. : 6,500,215 B1 
DATED : December 31, 2002
INVENTOR(S) : Login et al.

It is certified that error appears in the above-identified patent and that said Letters Patent is hereby corrected as shown below:

Column 19,
Lines 37-42, Claim 12 should read:

21. A process as defined in claim 16, wherein said amine oxide is a material, having the following formula:

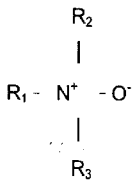

wherein $R_3$ is a $C_1$ to $C_8$ linear or branched alkane radical or hydroxyalkyl group, and $R_1$ and $R_2$ are $C_1$ to $C_8$ linear or branched alkane radicals or hydroxyl groups or form a 5 to 6 membered heterocyclic ring.

Signed and Sealed this

Twenty-seventh Day of May, 2003

JAMES E. ROGAN
*Director of the United States Patent and Trademark Office*